United States Patent [19]

Harris

[11] 4,404,003

[45] Sep. 13, 1983

[54] MICROWAVE HEATING PROCESS FOR GRINDING WHEELS

[75] Inventor: Denis I. Harris, Nazeing, England

[73] Assignee: Norton Company, Worcester, Mass.

[21] Appl. No.: 312,061

[22] Filed: Oct. 16, 1981

[30] Foreign Application Priority Data

Jul. 15, 1981 [GB] United Kingdom ..... 8121831

[51] Int. Cl.[3] ..... C09K 3/14

[52] U.S. Cl. ..... 51/298; 51/293

[58] Field of Search ..... 51/293, 298

[56] References Cited

U.S. PATENT DOCUMENTS

| | | | |
|---|---|---|---|
| 2,233,176 | 2/1941 | Melton et al. | 51/298 |
| 2,469,398 | 5/1949 | Meyer | 51/298 |
| 3,115,401 | 12/1963 | Downing | 51/298 |
| 3,116,986 | 1/1964 | Goepfert | 51/298 |
| 3,208,836 | 9/1965 | Biglin | 51/298 |
| 3,323,885 | 6/1967 | Rowse | 51/298 |
| 3,950,149 | 4/1976 | Fukuda | 51/298 |
| 3,980,453 | 9/1976 | Fukuda | 51/297 |
| 4,115,077 | 9/1978 | Fukuda | 51/298 |
| 4,150,514 | 4/1979 | Douglass | 51/298 |

FOREIGN PATENT DOCUMENTS

| | | |
|---|---|---|
| 494407 | 7/1953 | Canada . |
| 2028861 | 3/1980 | United Kingdom . |

*Primary Examiner*—Donald E. Czaja
*Assistant Examiner*—W. Thompson
*Attorney, Agent, or Firm*—Arthur A. Loiselle, Jr.

[57] ABSTRACT

A method for making low porosity resin bonded product containing abrasive grams by preheating the abrasive grain mix prior to pressing and curing to a temperature within a range to just soften or partially liquidy the resin and which does not cure it. The heating is done with dielectric heating field and then the heated mix is cold pressed in a mould to the desired density, and the resin heat cured to produce the finished product.

13 Claims, No Drawings

MICROWAVE HEATING PROCESS FOR GRINDING WHEELS

TECHNICAL FIELD

The invention relates to a process for making cold pressed, hard, dense grinding wheels.

BACKGROUND ART

Prior Art Statement

The following patents are representative of the most relevant prior art known to the applicant at the time of filing the application:

| | | |
|---|---|---|
| | U.S. Pat. No. | |
| 2,233,176 | February 25, 1941 | R. L. Melton et al |
| 2,469,398 | May 10, 1949 | E. Meyer |
| 3,950,149 | April 13, 1976 | H. Fukuda |
| 3,980,453 | September 14,1976 | H. Fukuda |
| 4,150,514 | April 24, 1979 | T. E. Douglass |
| | Foreign Patents | |
| 494,407 | July 14, 1963 | Canada |
| 2,028,861 | March 12, 1980 | United Kingdom |

It has been shown in U.S. Pat. No. 4,150,514 to Douglass, Apr. 24, 1979, that microwave energy can be used to heat a resin and refractory grain mix to a temperature within a range of 90° C. to 120° C., then compact the heated mix in a heated mold or hot press to produce a density within a range of from 2 to 4 grams per cubic centimeter. The compacted mass is continuously heated in the mold until the designed density is accomplished and the resin is converted to a solid state. Either a thermo-plastic or thermo-setting resin may be used.

U.S. Pat. No. 2,233,176 to Melton et al., Feb. 25, 1941, and Canadian Pat. No. 494,407 to Rowe, July 14, 1953, illustrate the use of high frequency electro-static energy for heating and then curing the resin bond in molded shapes supported within such an electrical field.

U.S. Pat. No. 2,469,398 to Meyer, May 10, 1949, shows first conventionally heating an abrasive mix in a mold to preheat the mix and then applying pressure to the material in the mold to cure the resin. The heat source is not specified nor is the temperature range.

British Pat. No. 2,028,861 to Obersby, Mar. 12, 1980, discloses the use of microwave energy on a preformed abrasive product or wheel to cure a resin bond ingredient of the mix.

The U.S. Pat. Nos. 3,950,149 of Apr. 13, 1976 and 3,980,453 of Sept. 14, 1976, both issued to Fukuda, disclose a process for making an abrasive and resin bond mix that is formed into a brick shape that is then heated with a microwave source of electrical energy. The heated brick is rolled out into a flat shape and grinding wheel blanks are cut out of the flat sheet. The blanks are heated in a conventional electrically heated tunnel kiln to cure the resin.

DISCLOSURE OF THE INVENTION

According to the invention therefore there is provided a method for making a low porosity resin bonded product that contains abrasive grains, comprising mixing the grains with a powdered resin powdery composition, preferentially heating the resin in the mix by dielectric heating field to soften at least part of the resin the maximum temperature achieved by the resin portion being below that at which significant curing takes place, in applying pressure to the preheated mix on a mould to produce a dense shape, removing the pressure and subsequently curing the resin in the compressed mix to form the bonded product.

The mix can be loosely compacted and the heating restricted to give a maximum temperature so that the resin particles do not sinter sufficiently to become significantly tacky, so that the mix after heating can be 'levelled' in a mould prior to pressing. Alternatively the mix can be levelled and compacted before the dielectric heating step such that 'levelling' after the heating is not necessary. In this case the maximum temperature reached during the dielectric heating step is not so restricted. Indeed in certain cases it can be desirable to make the resin fluid prior to pressing. Alternatively the loosely compacted mix can be levelled in the final pressing mould and without removal can be preheated prior to the pressing step. In this case also the levelled loosely compacted mix need not be restricted in its maximum temperature. After dielectric heating the mix, loose or compacted, is levelled if necessary and feasible and cold pressed to a designed density. This 'cold pressed' body can be subsequently heated to substantially cure the resin and to form an organic grinding element, usually a wheel. The heating is preferential i.e. it is the resin which is heated and theoretically it is the resin temperature which is critical. As it is impractical to measure the temperature of the resin only the temperatures are measured for the mix but as these are lower than the resin it is imperative that care be taken to avoid heating which effects curing even though the overall temperature of the mix is lower than the curing temperature. Where the mix is to be heated in a loose form then the mix can be preheated to a temperature of from 35° C. to 60° C. in its loose condition under circumstances such that caking of the loose material is precluded in order that the preheated mix can be spread smoothly in the cold press mould for uniform compaction to the desired density for curing. The moulds and presses may be conventional equipment having a pressure available that is adapted to produce the desired density in the pressed object and in following the preferred operation of this aspect of method, the mould plates are not held spaced apart with spacer blocks as is sometimes done to gauge the ultimate thickness of the pressed shape.

'Dielectric' heating includes what are known as Radio Frequency (or dielectric) and microwave heating. The usual frequencies used in the former are 13.56,27.12,84 MWZ and in the latter 896 (in the United States 915),2450 and potentially 5800 and 24,125 MWZ. This 'dielectric' heater relies on the existence of a significant electrical 'loss factor', as is common with phenol-formaldehyde resin.

It has been found, by preheating a loose resin and abrasive mix in a high dielectric field for example a high frequency microwave field and then levelling the preheated mix while still warm in a cold press mould followed by cold pressing and separate curing in an oven that a desired porosity can be produced with less pressure than has heretofore been conventionally required. The degree of preheat induced in the loose mix must be controlled to produce a mix that flows freely into the mould to form a uniform layer for cold pressing to the desired density. It has been found that the combination of (1) controlled preheating of the loose resin and abrasive grain mix in a dielectric, e.g. microwave, heater, (2) cold pressing to produce a desired shape, and, (3), conventional curing of the resin, permits the production of a finished, dense resin bonded structure with less pressing force than is conventionally required.

This invention can best be illustrated in its adaptation to the production of certain conventional resin bonded grinding wheels, wherein a thermosetting resin can be used. Either thin dense wheels in the size range of ⅜" or thicker wheels to as thick as 10" may be made by following the method described herein.

The preferred method may be utilized with any of the known resins conventionally used with the usual kinds of abrasive grain such as alumina, alumina-zirconia, silicon carbide, diamonds, or other grinding media. The powdered resin composition or size of the abrasive grain in the mix is not critical. The grain may be combined with conventional fillers and additives and mixed with the powdered resin bond composition, all as is well known in the art. The resin composition is selected from those that are normally a powder until activated by heat and that can be intimately mixed in their powdered form with the abrasive grits and other components of known formulations for the making of resin bonded wheels.

The conventional abrasive and resin compositions can be subjected to the steps of this invention, but the most useful results are realized when the method is used for the production of hard wheels and the denser types of bonds. The invention process has particular utility in fabricating wheels in the porosity range of about 16 to 8%. This range of product, especially toward the lower porosity end, is difficult or impossible to manufacture by the standard cold pressing method.

After the resin and abrasive grain components of the wheel mix have been thoroughly and intimately blended together, the loose mix is subjected to a microwave heating step to heat rapidly the resin coated abrasive particles to soften the resin component of the mix without rendering it liquid or affecting any degree of hardening of a heat setting resin. Such softening of the resin to the degree desired is accomplished in a microwave electrical field that selectively affects the resin component, without appreciably heating the abrasive grit in the mixture. Prior to performance of the microwave heating of the resin, the powdered resin, wetting agent and other additives, if any, and the abrasive grain should be thoroughly blended together such as is accomplished in the usual mixing pans at ambient temperatures. The loose mix may then be subjected to the microwave, high frequency electrical field to be heated or the mix may be loosely spread in a cold pressing mould prior to the preheating step. But, in either case, while the abrasive grain and resin mix is in its loose uncompacted state, it is subjected to the microwave field to soften the resin component of the mix. Such heating can be accomplished in a matter of minutes and then this heated abrasive mix is pressed to its final shape in a conventional cold pressing mould.

During the development of this process, a typical phenolic resin 80 grit (FEPA or ANSI designation) alumina abrasive grain mix, used for making thin dense cut-off wheels, was preheated in a microwave field to raise the temperature of the mix to temperatures within a range of from 55° C. to 81° C. in batches of a size to produce cold pressed thin grinding wheels in a 6" diameter mould and ⅜" thick. The respective batches from which these wheels were made, were heated for from 3 to 5 minutes in a 2 KW microwave heater and the pressures required to cold press the test wheels were recorded. Also, conventional cold pressed wheels having the same dimensions were made from the same mix in the same press at the same degree of pressure for comparison. The cold pressed wheels made with the preheated mix and the conventional wheels made with the unheated mix were all fired under identical conditions to cure the resin. The wheels made with unheated mix after being fired, were analized and these wheels were determined to have a porosity of 12%. The preheated mix resulted in wheels having a porosity of 10% which indicates that the wheels made with a preheated mix are denser wheels when all of the other manufacturing steps are controlled to be identical. The following is a tabulation of the resulting data:

TABLE I

Effects of Microwave Preheat on Cold Pressed Wheel Density
Wheel Size: 6 × ⅜ × 0"
Cold Press

| Microwave Preheat | Mix Temp. at Cold Press | Unit Pressure | Wt/Vol. | Young's Modulus of Elasticity |
|---|---|---|---|---|
| None | 25° C. | 5.9 tons/in$^2$ | 2.68 g/cc | $28.5 \times 10^{10}$ |
| None | 25° C. | 4.3 tons/in$^2$ | 2.62 | $27.1 \times 10^{10}$ |
| 3 Min. at 2KW | 55° C. | 5.9 tons/in$^2$ | 2.74 | $29.2 \times 10^{10}$ |
| 4 Min. at 2KW | 76° C. | 5.9 tons/in$^2$ | 2.74 | $29.3 \times 10^{10}$ |
| 5 Min. at 2KW | 81° C. | 5.9 tons/in$^2$ | 2.75 | $30.2 \times 10^{10}$ |

It can be observed that when the same pressure is applied to the separate preheated batches that have been heated respectively to different temperatures as compared with the abrasive mix that was cold pressed at ambient temperature and then after all the wheels have been cured under identical conditions, that the finished fired preheated products had higher densities.

It is seen then, that in following this method, that denser wheels can be produced when compacting pressure is applied to the respective mixes in a cold press. Thus, as compared with wheels made with an unheated mix when the same conditions prevail, for any given resin bonded abrasive grain mix, denser wheels can be produced, using the conventional pressures now used in the cold pressing equipment, or with relatively less pressure than has been required heretofore, wheels having the same density and strength as wheels produced in the conventional cold pressing process, can now be produced in a press requiring less pressure by following the described preheating step performed on the loose abrasive grain and resin mix.

The method is best adapted for use with heat setting resins, such as phenol-aldehyde, epoxy, and polyester resins and the like, wherein an initial softening of the resin component of the loose abrasive mix can be accomplished under the control of the input energy in the microwave preheating step that is quickly accomplished before any liquidification or heat curing of the resin results. Care must be taken to avoid rendering the resin component too fluid which results in balling or caking of the components of the mix, if it is first heated in a loose bulk condition in the mixing pan or another container and is then transferred to be spread in the cold pressing mould. When balling occurs in the loose mix, uniform spreading of the mix in the mould prior to pressing is more difficult, if not impossible, to complete.

With a phenolic resin bond powder in an abrasive grain mix, it has been found that a preheating of the mix to a temperature with a range of from 35° C. to 60° C. substantially eliminates any tendency within the mix for caking or balling. Preferably, the preheating of a phenolic resin abrasive wheel loose mix used for producing the hard dense wheels of this invention, is kept within a range of from 40° C. to 50° C.

When the mix is levelled and compacted before the microwave heating, subsequent to the final cold pressing step, then the concern with respect of the balling effect is removed. The mix may be levelled and compacted in the final 'cold pressing' mould, when the dielectric heater must be specially designed to fit the mould and expensive mould equipment is tied up during the performance of the preheating step, although this only takes a few minutes. Alternatively the mix may be levelled and compacted in another mould, preferably making a lightly compacted body which after heating is of sufficient composition to be handled for transference to the finishing mould. Here the initial moulding will preferably give a compact which is of slightly smaller size, thus giving more clearance internally and/or externally in the first mould. The maximum temperatures attained during dielectric heating of a levelled and compacted mix can be higher than when the mix is "loose". In certain formulations this is desirable so that low wheel porosities can be attained. The resin will be fluidised or melted and will have reached temperatures not far from those considered necessary to achieve the onset of cure. As the dielectric heater preferentially heats the resin, to a temperature, the measured mix temperature will be lower than that which the resin reached.

Cold pressing can be done in a mould having spacing blocks in position to precisely control the thickness of the moulded object if that is desired. Alternatively, the moulded object may be made by pressing to a predetermined pressure. Both methods are well known.

In the "cold press" one could have a means for slightly warming the platens. This would avoid heat loss but such slight heating is readily distinguishable from the very considerable heat sources required for hot press techniques. Consequently any modification of the conventional cold press would not be equivalent to the expensive hot press.

Preheating the resin in a abrasive grain and resin bond mix has particular utility in the production of the denser harder grades of grinding wheels. The preheating step minimizes the degree of pressure required for the production of any given density of resin-abrasive mix and thus lower cost equipment may be used and since the degree of pressure required to produce a given wheel specification has been reduced, use of this process minimizes wear on the mould. While preheating an abrasive mix has been described above for the production of hard dense wheels, it will have some application for use with other types of thinner and softer grade wheels where the desired density of the wheel is not so difficult to attain, for the production of such wheels, preheating may be used but it is not so essential as in the process of making the harder, denser specifications.

Conventional dielectric heating equipment is used to preheat the abrasive and resin mix. As is known frequencies of 13.56, 27.12, 84.896, 2450, 5800 and 24,125 MWZ (915 replaces 896 in the United States) are available. 896 and 2450 are readily available microwave frequencies is utilised in industrial equipment. 5800 and 24,125 frequency heaters are not readily available. 84 MWZ in the R.F. heating equipment is the preferred frequency. Although the frequency used for preheating the mix is not too critical it is found, as is well known, that R.F. frequencies have less utility when electrcally conducting materials are present and the mix is 'loose'. The higher microwave frequencies are of less utility when heating large depths of mix.

In following this method, grinding wheels from ⅜" to 10" in thickness have been produced that have been found to be well within the commercial tolerance range for balance, thickness, and density, making use of the cold press process utilizing from 20% to 50% less pressure than is required for the production of a similar grades and densities of wheels with identical mixes that have not been preheated.

EXAMPLES OF THE PREFERRED EMBODIMENTS

Example I

Two sets of grinding wheels 20"×0.405"×10" having 12% pores, 46 volume % abrasive and 42 volume % bond, were made in the following manner:

A master batch of mix was prepared by placing 80 grit aluminum oxide in a mixing pan, wetting the abrasive with furfural, dumping a powdered phenolic resin bond on the wetted abrasive and mixing these materials until essentially all of the powdered phenolic resin based bond was adhered to the furfural wetted abrasive grains.

The bond had the following weight percent composition:

| | |
|---|---|
| Powdered phenolic resin | 40.5% |
| Barium sulfate | 54.2% |
| Lime | 5.3% |

The master batch of mix was split into two portions. From one portion wheels were cold pressed in the conventional manner. This grinding wheel specification being a relatively dense one, i.e. low in porosity, required a high amount of pressure to compress the mix to the desired wheel density of about 2.66 g/cm$^3$. The amount of pressure required was 10.6 tons per square inch (tpi), just below the safe limit of the steel mould equipment used.

The second portion of mix was further divided into three smaller portions, each of which was laced in a separate polyethylene container. Each portion of mix was then heated to a different temperature viz. 40° C., 45° C., and 50° C. in a microwave heating unit. While each mix was still warm, a predetermined amount was transferred to a standard steel mould set-up, levelled and pressed to the desired size. The amount of pressure required to press the mix to the desired thickness in all cases was only 5.3 tpi, only one half the amount of pressure required to accomplish the same wheel thickness when the standard cold pressing technique was use.

The properties of the wheels made by the standard cold press method of the invention were as follows:

TABLE II

| Mode of Heating | Preheat Temp (°C.) | Pressure (tsi) | Thickness (Inch) | Density (g/cm$^3$) | Modulus* |
|---|---|---|---|---|---|
| None | — | 10.6 | .405 | 2.68 | 27 |
| None | — | 10.6 | .402 | 2.65 | 28 |
| Microwave Preheat | | | | | |
| 3 KW-1 Min. | 40 | 5.3 | .405 | 2.65 | 26 |
| 3 KW-2 Min. | 45 | 5.3 | .405 | 2.66 | 26 |
| 3 KW-2 Min. | 45 | 5.3 | .405 | 2.65 | 29 |

TABLE II-continued

| Mode of Heating | Preheat Temp (°C.) | Pressure (tsi) | Thickness (Inch) | Density (g/cm³) | Modulus* |
|---|---|---|---|---|---|
| 3 KW-2.5 Min. | 50 | 5.3 | .405 | 2.67 | 28 |

*Note: Young's Modulus of Elasticity.

Example II

Two sets of grinding wheels 18"×0.365"×8" having 12% pores, 46 volume % abrasive, and 42 volume % bond were made in the same manner as the wheels in Example I except that in this case 100 grit aluminum oxide abrasive was used instead of the 80 grit of Example I and liquid phenolic resole was used as the wetting agent in place of furfural. These wheels also differed in the bond composition which had the following weight percent composition:

| | |
|---|---|
| Powdered phenolic resin | 32.0% |
| Iron pyrites | 38.0% |
| Silicon carbide fines | 25.6% |
| Liquid phenolic resin | 4.4% |

As in Example I the master batch of wheel mix was split into two portions. Standard wheels and wheels according to the invention were made as described in Example I. The pressure required to compress the mix to the desired degree of compaction was again 10.6 tpi for the standard cold pressed wheels. The portions of the wheel mix that were heated prior to pressing were compacted to the desired degree of compaction with only half the pressure required for the unheated mix i.e. 5.3 tpi. The compared properties of these wheels was as follows:

TABLE III

| Mode of Heating | Preheat Temp. (°C.) | Pressure (tsi) | Thickness (Inch) | Density (g/cm³) | Modulus* |
|---|---|---|---|---|---|
| None | — | 10.6 | .366 | 2.73 | 29 |
| None | — | 10.6 | .370 | 2.73 | 30 |
| M-W Preheat | | | | | |
| 2.25 KW-1 Min. | 40 | 5.3 | .370 | 2.69 | 36 |
| 2.25 KW-1 Min. | 40 | 5.3 | .366 | 2.71 | 36 |
| 1.5 KW-1.75 Min. | 45 | 5.3 | .366 | 2.72 | 36 |
| 1.5 KW-1.75 Min. | 45 | 5.3 | .366 | 2.71 | 37 |
| 1.5 KW-2 Min. | 50 | 5.3 | .366 | 2.71 | 38 |
| 1.5 KW-2 Min. | 50 | 5.3 | .366 | 2.68 | 36 |

*Note: Young's Modulus of Elasticity.

Examination of the data shows that although these wheels are of the same density the same density the preheated wheels are stronger as shown by the increase in Young's Modulus of Elasticity.

As noted above, wheel mixes were microwave preheated to 40°, 45°, and 50° C. The mixes heated at 40° and 45° C. had excellent characteristics with respect to spreadability in the mould and the like. However, the portion of mix heated to 50° C. exhibited some inclination toward caking by way of a minor amount of balling. This was not a problem because simple screening of the mix broke up the balls. The significance is that temperature much in excess of 50° C. for this particular grinding wheel formulation, would not be acceptable from a processing point of view when using the loose mix technique. On the other hand there are grinding wheel formulations which are amenable to higher preheat temperatures and the method as described earlier can be varied.

Example III

While the method of the present invention is an improvement over the prior art in that it allows the production of relatively dense grinding wheels at lower pressures thus allowing the use of light presses and mould equipment, the present method also provides a means for making so-called cold pressed wheels in densities heretofore relatively impossible to make and also some stronger wheels for a given density.

Two sets of wheels, one set by the prior art cold press method, the other set according to the invention, were made exactly as in Example II, using that same formulation, with one distinction viz. the preheated wheels in this case were also pressed at 10.6 tpi as well as the standard wheels. Pressing the wheels, formed from the preheated mixes, resulted in wheels of greater density and strength than the wheels made using the conventional cold pressing technique. The results are shown in Table IV.

TABLE IV

| Mode of Heating | Preheat Temp. (°C.) | Pressure (tsi) | Thickness (Inch) | Density (g/cm³) | Modulus* |
|---|---|---|---|---|---|
| | — | 10.6 | .366 | 2.73 | 29 |
| | — | 10.6 | .370 | 2.73 | 30 |
| M-W Preheat | | | | | |
| 2.25 KW-1 Min. | 40 | 10.6 | .346 | 2.79 | 31 |
| 2.25 KW-1 Min. | 40 | 10.6 | .354 | 2.79 | 34 |
| 1.5 KW-2 Min. | 45 | 10.6 | .358 | 2.81 | 35 |
| 1.5 KW-1-75 Min. | 45 | 10.6 | .354 | 2.83 | 36 |
| 1.5 KW-2 Min. | 50 | 10.6 | .354 | 2.79 | 37 |
| 1.5 KW-2 Min. | 50 | 10.6 | .358 | 2.80 | 39 |

*Note: Young's Modulus of Elasticity.

An examination of the data shows that under the same pressing conditions, viz. 10.6 tpi, preheating of the mix results in a significantly denser, wheel which could not be made using the conventional method unless pressures were used that would exceed the safe operating limits of the mould equipment.

For the purpose of this disclosure, the use of the term "cold press" covers the use of a mould and pressure means for receiving and shaping the resin and abrasive mix without the application of a heat sufficient to cure the resin or to control the hardening characteristic of the resin during the pressing operation as distinguished from a "hot press" wherein an abrasive grit and resin mix is subjected to pressure while simultaneously heating the pressed mix to cure the resin or consolidate the resin and abrasive in the mould while the mix is under pressure.

A cold pressure mould as used in this invention could include some means of heat input or retention (by, for example, insulation). For example heating could be by electrical heating or steam to the plattens.

However, such heat would not be of the order employed in hot pressing which could effect cure and would be intended primarily to assist in retaining the heat in the mix from the dielectric heating step which might other wise be absorbed by the metal of the mould.

All of the above described moulding and pressing steps used for producing the wheels in accordance with this invention were performed in conventional cold pressing manufacturing equipment.

'Levelling' used herein means obtaining a uniform thickness to a mix so as to achieve after pressing a uniform density and homogeneity. The means of levelling are usually by the use of a spreading technique but may be done by other means e.g. vibration.

The above examples illustrate the best mode of performing this invention. It is possible that modifications thereof may occur to those skilled in the art that will fall within the scope of the following claims.

I claim:

1. A method for making a low porosity resin bonded product that contains abrasive grains, comprising mixing the grains with a powdered resin bonding composition, heating the resin in the mix by a dielectric heating field to soften at least part of the resin the maximum temperature achieved by the resin portion being below that at which significant curing takes place, cold pressing the preheated mix in a mould to produce a dense shape, removing the pressure and subsequently curing the resin in the compressed mix to form the bonded product.

2. A method according to claim 1 wherein the condition of compression and cure form a product with a porosity of 2 to 20% by volume.

3. A method according to claim 2 wherein the porosity is 8–20%.

4. A method according to any one of claims 1 to 3 wherein the heating results in an overall mix temperature of 35° to 81° C.

5. A method according to claim 4 wherein the mix is at from 40° to 50° C. immediately prior to application of pressure.

6. A method according to any one of claims 1 to 5 wherein the dielectric field is a microwave field.

7. A method according to claim 6 wherein the field is at 84, 896 or 2450 MWZ.

8. A method according to any one of claims 1 to 7 wherein the mix is in a loosely distributed condition prior to heating.

9. A method according to claim 8 wherein the heated mix is then placed in a mould and, if necessary, levelled.

10. A method according to any one of claims 1 to 7 wherein the mix is at least partially compacted prior to heating to form an initial shape.

11. A method according to claim 10 wherein the compacted, heated shaped mix is transferred from the heat treatment location to the pressurising mould.

12. A method according to any one of claims 1 to 11 wherein the product is a grinding wheel.

13. A method according to any one of claims 1 to 12 wherein the resin is a phenol-formaldehyde type resin and is finally cured by heating.

* * * * *